US006729277B2

(12) United States Patent
Yamaki et al.

(10) Patent No.: US 6,729,277 B2
(45) Date of Patent: May 4, 2004

(54) ELECTROMAGNETIC VALVE CONTROLLER

(75) Inventors: Toshihiro Yamaki, Wako (JP); Minoru Nakamura, Wako (JP); Yoshinori Onohara, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/002,845

(22) Filed: Nov. 14, 2001

(65) Prior Publication Data

US 2002/0056422 A1 May 16, 2002

(30) Foreign Application Priority Data

Nov. 14, 2000 (JP) ..... 2000-346243

(51) Int. Cl.[7] ..... F01L 9/04
(52) U.S. Cl. ..... 123/90.11; 361/149; 251/129.1
(58) Field of Search ..... 123/90.11; 361/149, 361/152, 153, 154, 155, 156, 160; 251/129.1, 129.15, 129.16

(56) References Cited

U.S. PATENT DOCUMENTS 5,818,680 A 10/1998 Schmitz et al. ..... 361/160
5,960,753 A * 10/1999 Sturman ..... 123/90.12
5,996,539 A * 12/1999 Gobel et al. ..... 123/90.11
6,081,413 A * 6/2000 Schmitz et al. ..... 361/160
6,234,144 B1 * 5/2001 Yamaguchi et al. ..... 123/399

FOREIGN PATENT DOCUMENTS

| | | |
|---|---|---|
| DE | 3733704 A | 4/1988 |
| DE | 4128434 A | 3/1993 |
| EP | 1022442 A | 7/2000 |
| JP | 6002599 | 1/1994 |

* cited by examiner

*Primary Examiner*—Thomas Denion
*Assistant Examiner*—Jaime Corrigan
(74) *Attorney, Agent, or Firm*—Lahive & Cockfield, LLP; Anthony A. Laurentano

(57) ABSTRACT

An electromagnetic valve controller estimates a dead time based on predetermined parameters. A dead time for the current cycle is determined based on the estimated dead time. The controller measures a dead time in the previous cycle. The controller determines a deviation between the dead time measured in the previous cycle and the dead time estimated in the previous cycle. The deviation is added to the dead time estimated in the current cycle to determine the dead time for the current cycle. The controller further determines a target de-energization timing indicating when to execute a valve timing command. The dead time determined for the current cycle is offset or subtracted from the target de-energization timing to determine an actual de-energization timing. An electromagnet of the valve is de-energized in accordance with the actual de-energization timing.

22 Claims, 9 Drawing Sheets

ELECTROMAGNETIC VALVE CONTROLLER

TECHNICAL FIELD

The invention relates to a controller for controlling opening/closing operation of an electromagnetic valve, and more specifically it relates to a controller for controlling the timing of de-energizing an electromagnet of the electromagnetic valve in accordance with a dead time determined based on known parameters.

BACKGROUND OF THE INVENTION

An electromagnetic actuator alternately supplies electric power to a pair of opposing electromagnets to drive an armature, which is placed between a pair of opposing springs, between one terminal position and the other terminal position. When the intake/exhaust valves of an internal combustion engine are driven through the electromagnetic actuator, it is possible to control the valve timing variably as compared with a mechanical actuator. The electromagnetic actuator makes it possible to improve the output characteristics and fuel efficiency of an engine. Therefore, it is desired to apply the electromagnetic actuator to the intake/exhaust valves of an engine as a future possibility.

In common electromagnetic valves, an armature which is seated as a result of being attracted by one of the electromagnets is released from the seated state when the one of the electromagnet is de-energized. The armature starts to move toward a neutral position at which the opposing force of each of the two opposing springs balances. At certain timing in synchronization with this movement, electric current is supplied to the other of the electromagnets to attract the armature.

As the armature approaches the other of the electromagnets, the magnetic flux grows abruptly. The work by the attractive force of the other of the electromagnets overcomes the sum of the slight work to draw the armature back by residual magnetic flux of the one of the electromagnets and a mechanical loss. Thus, the armature reaches a seated position of the other electromagnet. As seating takes place, holding current is supplied at an appropriate timing to maintain the armature in the seated position.

In actual valve operation, it is not easy to control the attractive force for maintaining the armature in the seated position, so that there is variation in the residual magnetic flux when the armature is released. As a result, a time period from the time when the electromagnet is de-energized to the time when the armature actually leaves the seated position varies, the time period being referred to as "dead time" hereinafter. It is desirable that the dead time has already elapsed by the time when a valve timing command for activating the valve opening/closing operation is actually executed. Otherwise, valve opening/closing operation cannot start quickly in response to the valve timing command, degrading the accuracy of valve timing.

Japanese Patent Application Laid-Open No. 6-2599 discloses a method for correcting a variation of a dead injection time for the fuel injection valve, the dead injection time being defined as a time period from the time when a driving signal is applied to the fuel injection valve to the time when the fuel injection valve is actually opened. According to the method, the dead injection time is determined from the rate of change of current flowing through the fuel injection valve. The timing for opening the fuel injection valve for the current cycle is determined based on the dead injection time determined when the fuel injection valve has been opened in the previous cycle.

The length of the dead time for the electromagnetic actuator varies depending on various parameters such as supplied voltage, engine load, holding current value, engine rotational speed, valve timing, etc. Since the above-mentioned conventional method determines the dead time for the current cycle based on only the dead time for the previous cycle, there may happen a delay in opening/closing valve operation when such parameters abruptly change. Therefore, the method may not achieve a proper engine performance.

There exists a need for an electromagnetic valve controller that determines the dead time more precisely to maintain the accuracy of valve timing.

SUMMARY OF THE INVENTION

According to one aspect of the invention, an electromagnetic valve controller for controlling an electromagnetic valve is provided. The controller estimates a dead time based on predetermined parameters. A dead time for the current cycle is determined based on the estimated dead time. An actual de-energization timing for de-energizing an electromagnet of the valve is determined based on the dead time determined for the current cycle. An electromagnet of the valve is de-energized in accordance with the actual de-energization timing. Thus, the accuracy of valve timing is maintained even when driving conditions abruptly change, because the dead time for the current cycle is determined based on the predetermined parameters showing the driving conditions. The predetermine parameter may include engine rotational speed, engine load, supplied voltage, holding current and valve timing.

According to one embodiment of the invention, the electromagnetic valve controller measures a dead time in the previous cycle. A deviation between the dead time measured in the previous cycle and the dead time estimated in the previous cycle is determined. The determined deviation is added to the dead time estimated in the current cycle to determine the dead time for the current cycle. Thus, the accuracy of valve timing is improved because the dead time estimated in the current cycle is corrected with the deviation generated in the previous cycle.

According to another embodiment of the invention, the electromagnetic valve controller further determines a target de-energization timing indicating when to execute a valve timing command, based on predetermined parameters such as valve timing and engine rotational speed. The dead time determined for the current cycle is offset or subtracted from the target de-energization timing to determine the actual de-energization timing. Thus, valve timing is carried out in accordance with driving conditions.

BRIEF DESCRIPTION OF THE DRAWINGS

FIG. 11(*b*) is a graph showing the response of valve operation to a valve timing command when an accelerator opening is abruptly changed in accordance with one embodiment of the invention.

DETAILED DESCRIPTION OF THE PREFERRED EMBODIMENTS

Figure 1:
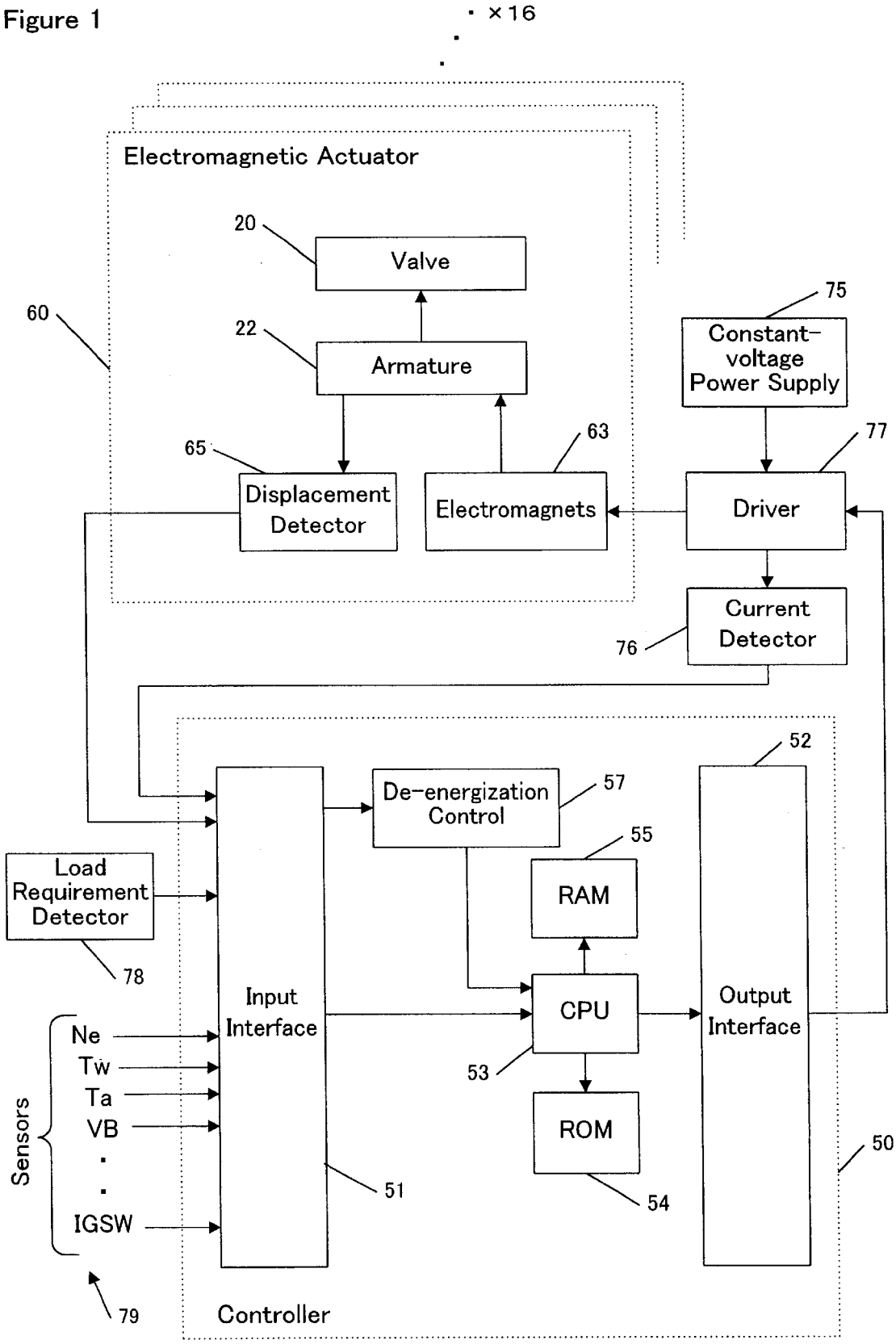
FIG. 1 is a block diagram showing the overall structure of an electromagnetic actuator and its controller in accordance with one embodiment of the invention.

An electromagnetic actuator for driving an engine valve will be below described with reference to the accompanying drawings. FIG. 1 shows the overall structure of an electromagnetic actuator 60 and a controller 50 for controlling the electromagnetic actuator 60.

The controller 50 comprises an input interface 51, a central processing unit 53 (hereinafter referred to as "CPU"), a ROM (read-only memory) 54 for storing programs to be executed and data, a RAM (random access memory) 55 which provides a working area for operations and stores the results of operations, and an output interface 52 for sending control signals to each of engine components.

The input interface 51 receives a displacement signal that is output from a displacement detector 65. The input interface 51 further receives signals from various sensors 79 indicating engine rotational speed (Ne), engine water temperature (Tw), intake air temperature (Ta), buttery voltage (VB), ignition switch (IGSW) and the like. A desired torque value detected by a load requirement detector 78 is also input to the input interface 51. In response to these inputs, the controller 51 determines parameters such as timing for supplying the electric power, the magnitude of the voltage to be supplied, and the duration for applying the voltage in accordance with control programs that are stored in the ROM 54, and outputs control signals for properly controlling the electromagnetic actuator 60 via the output interface 52. The load requirement detector 78 can be an accelerator-pedal sensor for detecting how deep the accelerator pedal is pushed down.

The electromagnetic actuator 60 typically uses a pair of electromagnets 63 to drive a valve 20. One may be referred to as a valve-opening electromagnet and the other may be referred to as a valve-closing electromagnet. When the valve-opening electromagnet is energized, an armature 22 is driven downward, thus the valve being opened. When the valve-closing electromagnet is energized, the armature 22 is driven upward, thus the valve being closed.

The displacement detector 65 detects the displacement of the armature 22. Any method may be used for detecting the displacement of the armature 22. For example, the displacement detector 65 comprises a permanent magnet moving along with the armature 22, and a coil for outputting a voltage proportional to a magnetic-flux density generated by the permanent magnet. The displacement of the armature 22 is detected based on the voltage detected from the coil.

Alternatively, the displacement detector 65 comprises a permanent magnet and a Hall element. The permanent magnet moves along with the armature 22. The Hall element detects a magnetic-flux density generated by the permanent magnet. The displacement of the armature 22 is detected based on the voltage detected from the Hall element. The displacement detecting process is described in detail in U.S. patent application Ser. No. 09/714,358, which is incorporated herein by reference.

In the embodiment, an automobile comprises total sixteen valves consisting of eight intake valves and eight exhaust valves. Therefore, sixteen electromagnetic actuators are mounted on the automobile. Each of the electromagnetic actuators includes the displacement detector 65.

A driver 77 subjects the voltage supplied from a constant-voltage power supply 75 to pulse width modulation in accordance with control signals from the controller 50, and supplies the modulated voltage to the electromagnets 63. A valve timing command for activating valve opening/closing operation for the valve 20 is one of the control signals issued by the controller 50. Upon receiving the valve timing command from the controller 50, the driver 77 starts energizing the valve-opening electromagnet or the valve-closing electromagnet, the valve opening or closing operation being activated, respectively.

A current detector 76 is connected to the driver 77. The current detector 76 detects the magnitude of the current applied to the electromagnets 63 to feed it back to the controller 50. The controller 50 determines parameters for controlling a driving current flowing through the electromagnets 63 based on the fed-back signal and provides the determined parameters to the driver 77. Thus, the driving current applied to the electromagnets 63 is optimized. The feedback control enables the fuel efficiency and output characteristics of an engine to be improved. In addition, the feedback control reduces the emission of an engine.

The controller 50 comprises a de-energization control part 57. The de-energization control part 57 determines an estimated dead time based on known parameters, which may include parameters detected by various sensors 79 and parameters pre-calculated by the controller 50. A dead time for the current cycle is determined based on the estimated dead time. A dead time refers to a time period from the time when the electromagnet is de-energized until the time when the displacement of the armature reaches a predetermined value (one millimeter in the case of the present example). The de-energization control part 57 determines, based on the dead time for the current cycle, an actual de-energization timing that indicates when to stop energizing or de-energize the electromagnets 63. The de-energization control part 57 outputs a control signal for de-energizing the electromagnets 63 to the driver 77 in accordance with the determined actual de-energization timing. In response to the control signal, the driver 77 stops supplying electric power to the electromagnets 63.

Figure 2:
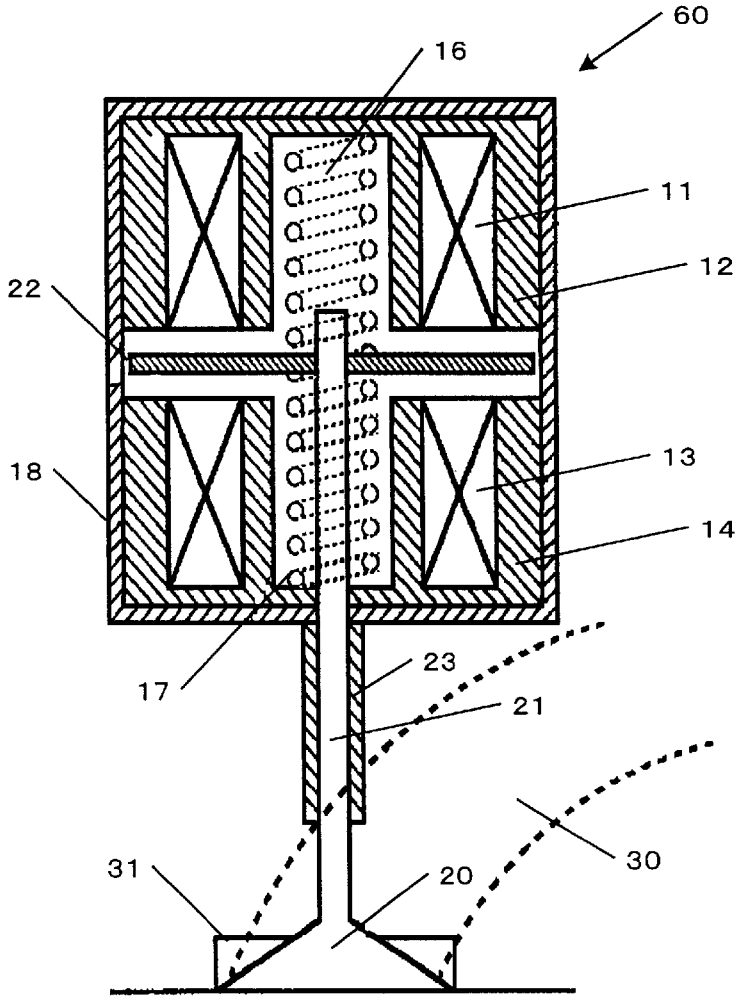
FIG. 2 is a diagram showing the mechanical structure of an electromagnetic actuator in accordance with one embodiment of the invention.

FIG. 2 is a sectional view showing the schematic structure of the electromagnetic actuator 60 shown in FIG. 1. The valve 20 is provided in the intake port or exhaust port (hereinafter referred to as the intake/exhaust port 30) of the internal combustion engine to open and close the intake/exhaust port 30. When the valve 20 is driven upward by the electromagnetic actuator 60, it is stopped at a position where it is tightly seated on a valve seat 31 installed in the intake/exhaust port 30 so that the intake/exhaust port 30 is closed. When the valve 20 is driven downward by the electromagnetic actuator 60, it leaves the valve seat 31 by a specified distance so that the intake/exhaust port 30 is opened.

The valve shaft 21 extending from the valve 20 is held in a bore of a valve guide 23 to enable it to move in an axial direction. A disk-shaped armature 22, which is made of a soft magnetic material, is attached to the upper end of the valve shaft 21. The armature 22 is supported jointly with respective upward and downward forces of a first spring 16 and a second spring 17.

A housing 18, which is made of a non-magnetic material, includes the valve-closing electromagnet 11 located above the armature 22 and the valve-opening electromagnet 13 located beneath the armature 22. The valve-closing electromagnet 11 is surrounded by a first magnetic yoke 12 and the valve-opening electromagnet 13 It is surrounded by a second magnetic yoke 14. The first spring 16 and second spring 17 are provided in a balanced configuration so that the armature 22 is held in the middle of the gap between the valve-closing electromagnet 11 and valve-opening electromagnet 13 when no driving current is applied to either the valve-closing electromagnet 11 or valve-opening electromagnet 13.

When the driver 77 supplies a driving current to the valve-closing electromagnet 11, the first magnetic yoke 12 and the armature 22 are magnetized to attract each other, so that the armature 22 is attracted upward. The valve 20 is driven upward by the valve shaft 21 and stops when the armature 22 is seated on the first magnetic yoke 12. Thus, the valve 20 is closed.

When the driver 77 stops supplying a driving current to the valve-closing electromagnet 11 and starts supplying a driving current to the valve-opening electromagnet 13, the second magnetic yoke 14 and the armature 22 are magnetized to attract each other, so that the armature 22 is driven downward with the action of the gravity. The valve 20 is driven downward by the valve shaft 21 and stops when the armature 22 is seated on the second magnetic yoke 14. Thus, the valve 20 is opened.

Figure 3:
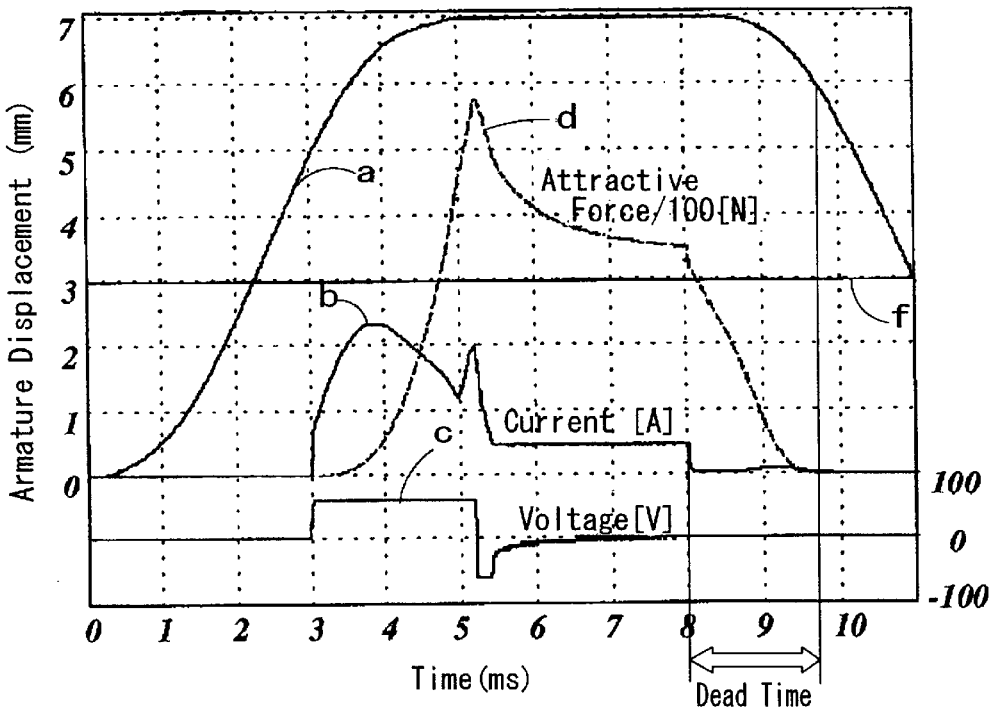
FIG. 3 is a graph showing output characteristics when a valve is driven by an electromagnetic actuator in accordance with one embodiment of the invention.

Referring to FIG. 3, a driving scheme of the electromagnetic actuator 60 in accordance with one embodiment of the present invention will be described. The curve (a) on FIG. 3 shows the displacement of the armature 22. The position marked as 0 mm on the left vertical axis indicates the first terminal position. The other or second terminal position is located 7 mm from the first terminal position. The curve (b) shows the current that is supplied to the valve-closing electromagnet 11, the curve (c) shows the voltage that is supplied to the valve-closing electromagnet 11, and the curve (d) shows the attractive force that is generated by the valve-closing electromagnet 11.

When a holding current supplied to the valve-opening electromagnet 13 is stopped while the armature 22 is seated on the second yoke 14 and the valve 20 is open, the armature 22 is released from the second yoke 14 and begins to move toward the valve-closing electromagnet 11 by means of potential energy of the first spring 16 and the second spring 17 (at 0 ms). Around the time when the armature 22 reaches the neutral position in which the forces of the first and second springs 16 and 17 are balanced (three milliseconds after the armature begins to move), the controller 50 sends a control signal to the driver 77 to apply a constant voltage to the valve-closing electromagnet 11, as shown by the curve (c).

When the voltage supply is initiated, a counter electromotive force generated in the valve-closing electromagnet 11 is small because the gap between the armature 22 and the first yoke 12 is large. Since the voltage supplied to the valve-closing electromagnet 11 is controlled to be at a constant value, the current supplied by the driver 77 increases as an electrical load reduces, as shown by the curve (b). Accordingly, the supply of the electric power into the electromagnet 11 increases. As a result, the magnetic flux generated by the valve-closing electromagnet 11 increases and an attractive force grows, as shown by the curve (d).

When the armature 22 reaches the first yoke 12 and is seated, the supply of the constant voltage is stopped, and the system switches to a constant-current mode. In the constant-current mode, a holding current of approximately 1.5 amperes is applied to the valve-closing electromagnet 11. In the example of FIG. 3, switching to the constant-current mode is carried out around the time point of 5.2 ms. The constant-current mode continues until the time point of 8 ms.

In order to move the armature 22 downward and start the opening operation for the valve 20, the supply of the holding current is stopped (at 8 ms). The armature 22 is released from the first yoke 12 and begins to move toward the valve-opening electromagnet 13 by means of potential energy of the first spring 16 and the second spring 17. The armature leaves the first yoke 12 by one millimeter around the time point of 9.7 ms.

As described above, a dead time means a time period from the time when the electromagnet is de-energized until the time when the displacement of the armature reaches a predetermined value (one millimeter in the case of the present example). In the example shown in FIG. 3, the dead time is about 1.7 milliseconds, as shown by the time period between the time points of 8 ms and 9.7 ms.

Thus, there is a delay of the length of the dead time between the time when the electromagnet is de-energized and the time when the displacement of the armature reaches one millimeter. In order to start the valve opening/closing operation quickly in response to the valve timing command, the de-energization of the electromagnet is carried out earlier than the execution of the valve timing command by the length of the dead time.

Figure 4:
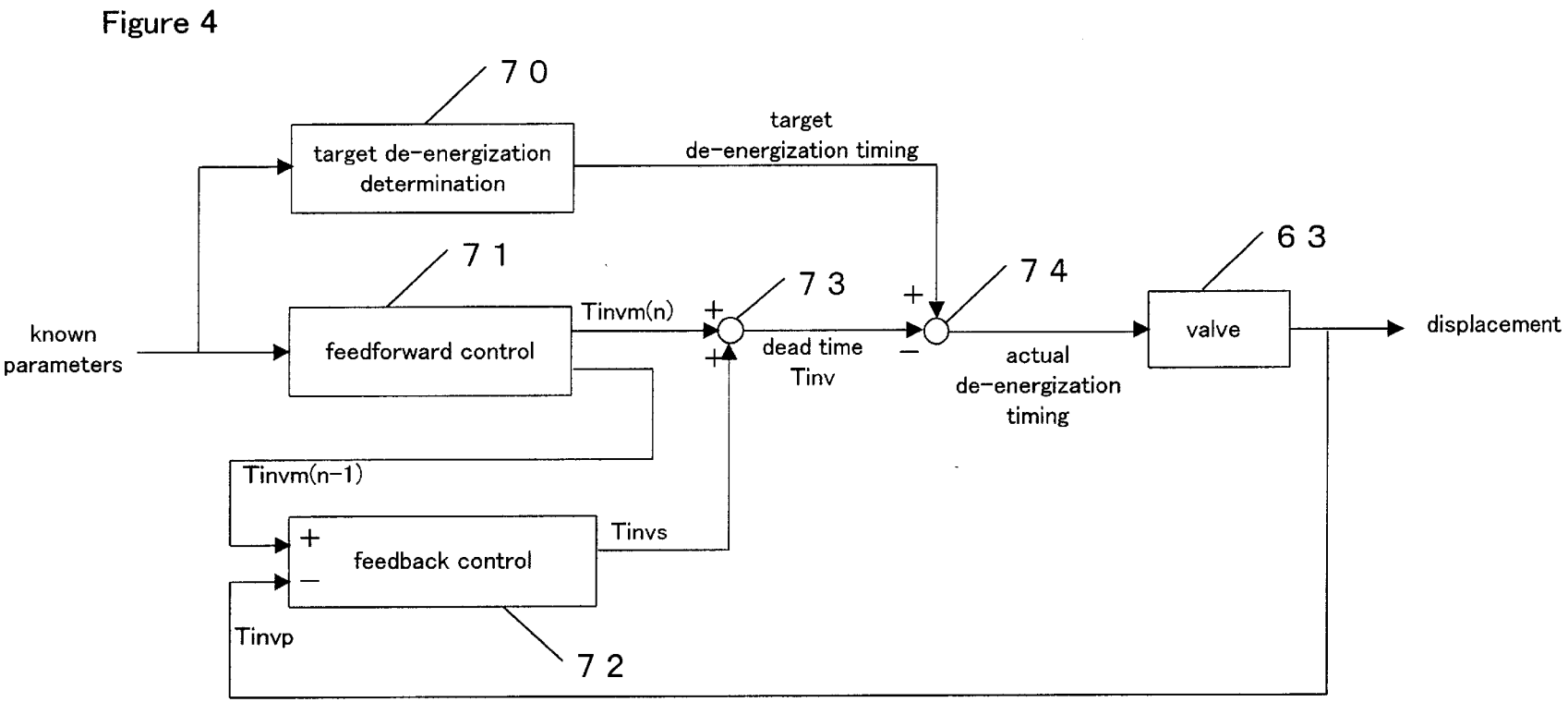
FIG. 4 is a block diagram showing the detail of a de-energization control part in accordance with one embodiment of the invention.

FIG. 4 schematically shows functional blocks of the de-energization control part 57 shown in FIG. 1. Typically, computer programs stored in a memory medium such as a ROM, a magnetic disk, an optical disk, and a nonvolatile memory realize these functional blocks. Alternatively, it is also possible to build hardware to practice the functions of these functional blocks.

The de-energization control part 57 comprises a feedforward control part 71 and a feedback control part 72. The feedforward control part 71 determines an estimated dead time Tinvm based on known parameters. The determination of the estimated dead time is carried out for each cycle in which the opening or closing operation for a valve is performed. Tinvm(n) indicates the dead time for the current cycle while Tinvm(n−1) indicates the dead time for the previous cycle. The estimated dead time Tinvm is stored in a memory by the feedforward control part 71.

The feedback control part 72 determines a deviation Tinvs between the dead time Tinvp that has been actually measured in the previous cycle and the estimated dead time Tinvm(n−1) that has been determined by the feedforward control part 71 in the previous cycle. More specifically, the deviation Tinvs is determined in accordance with the following equation (1):

$$Tinvs=Tinvm(n-1)-Tinvp \quad (1)$$

An adder 73 adds the estimated dead time Tinvm(n) for the current cycle and the deviation Tinvs to determine the dead time Tinv for the current cycle as follows:

$$Tinv=Tinvm(n)+Tinvs \quad (2)$$

The de-energization control part 57 further comprises a target de-energization determination part 70 that determines a target de-energization timing based on known parameters. The target de-energization timing indicates when the valve timing command is to be executed. The dead time Tinv is subtracted from the target de-energization timing to determine an actual de-energization timing. The electromagnet of the valve 63 is de-energized in accordance with the determined actual de-energization timing.

The goal is that the armature reaches at a position that is separated from the yoke by one millimeter when the valve timing command is executed. De-energizing the electromagnet in response to the actual de-energization timing enables the goal to be achieved.

Once the electromagnet is de-energized at the actual de-energization timing, the electromagnetic valve 63 begins to move. The displacement of the valve 63 is detected by the displacement detector 65 (FIG. 1). The time required for the valve 63 to reach the position that is separated from the yoke by one millimeter is measured. The measured dead time Tinvp is fed back to the feedback control part 72.

Referring to FIGS. 5 through 8, a method for determining the estimated dead time Tinvm based on known parameters, which is performed by the feedforward control part 71, will be described. In the embodiment, engine rotational speed, engine load, supplied voltage, valve timing and hold current value are used as the known parameters. However, any other parameters or any of the above-listed parameters may be used for determining the estimated dead time.

Figure 5:
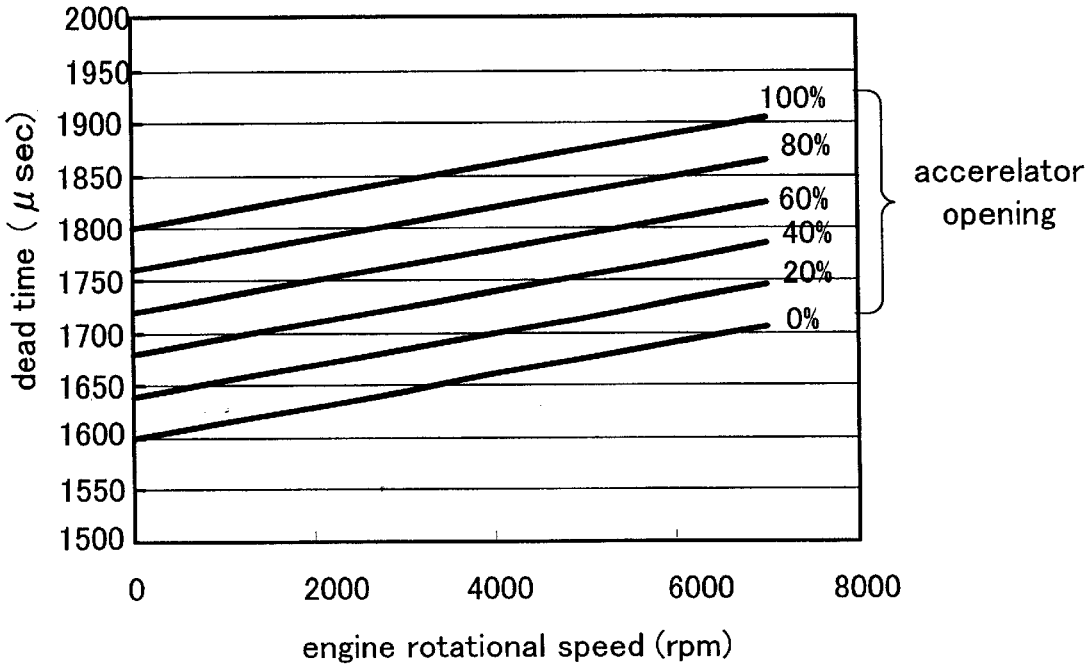
FIG. 5 is a graph showing the relationship among engine rotational speed, engine load, and dead time in accordance with one embodiment of the invention.

FIG. 5 is a graph showing a relationship among dead time, engine rotational speed and engine load. The graph has been pre-obtained through experiments and simulations and is stored as a map in the ROM 54 (FIG. 1) of the controller 50. An accelerator opening, which shows a quantity of the accelerator pedal being pushed down, is used to represent the engine load. The feedforward control part 71 receives a signal indicating the engine rotational speed (Ne) from the engine rotational speed sensor and a signal indicating the accelerator opening from the load requirement detector 78. The feedforward control part 71 determines a first dead time Tinvb from the map shown in FIG. 5 based on the received engine rotational speed and accelerator opening.

Figure 6:
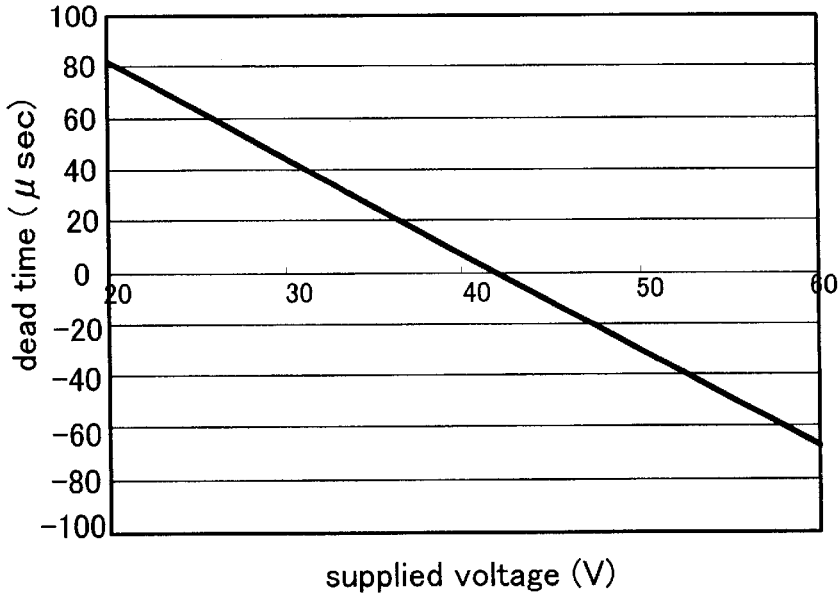
FIG. 6 is a graph showing the relationship between supplied voltage and dead time in accordance with one embodiment of the invention.

FIG. 6 is a graph showing a relationship between dead time and supplied voltage in which the dead time corresponding to the supplied voltage of 42 volts is used as a reference value. The graph has been pre-obtained through experiments and simulations and is stored as a map in the ROM 54 of the controller 50. The feedforward control part 71 receives a signal indicating the supplied voltage value and determines a second dead time Tinvv from the map shown in FIG. 5 based on the received supplied voltage value.

Figure 7:
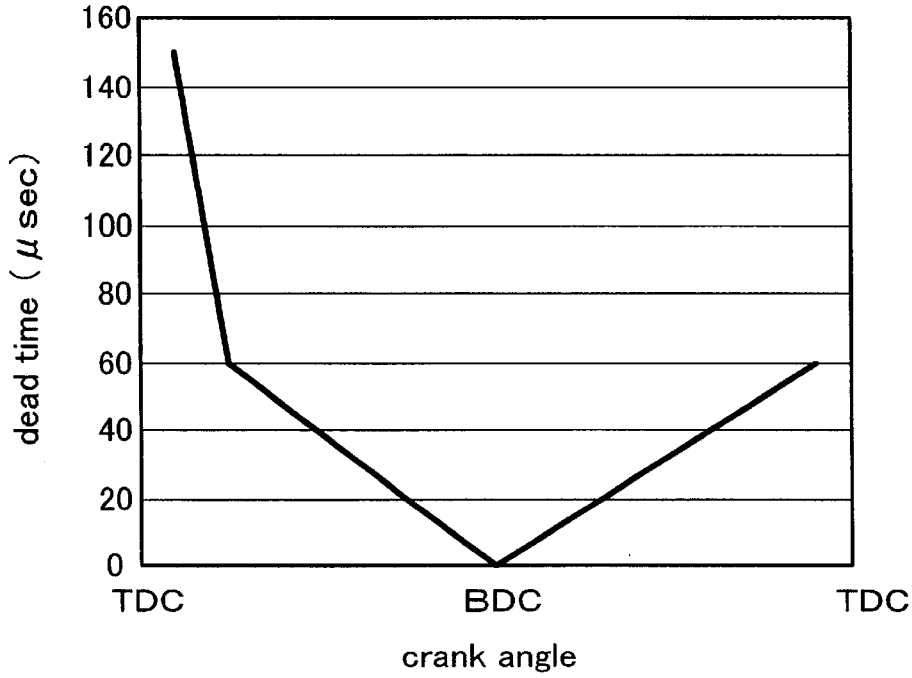
FIG. 7 is a graph showing the relationship between valve timing and dead time in accordance with one embodiment of the invention.

FIG. 7 is a graph showing a relationship between dead time and valve timing in which the dead time corresponding to the open state of the valve at BDC is used as a reference value. TDC and BDC in FIG. 7 indicate the top dead center and the bottom dead center, respectively. The graph has been pre-obtained through experiments and simulations and is stored as a map in the ROM 54 of the controller 50. The feedforward control part 71 determines a third dead time Tangle from the map shown in FIG. 7 based on the received valve timing which is expressed in terms of the crank angle.

Figure 8:
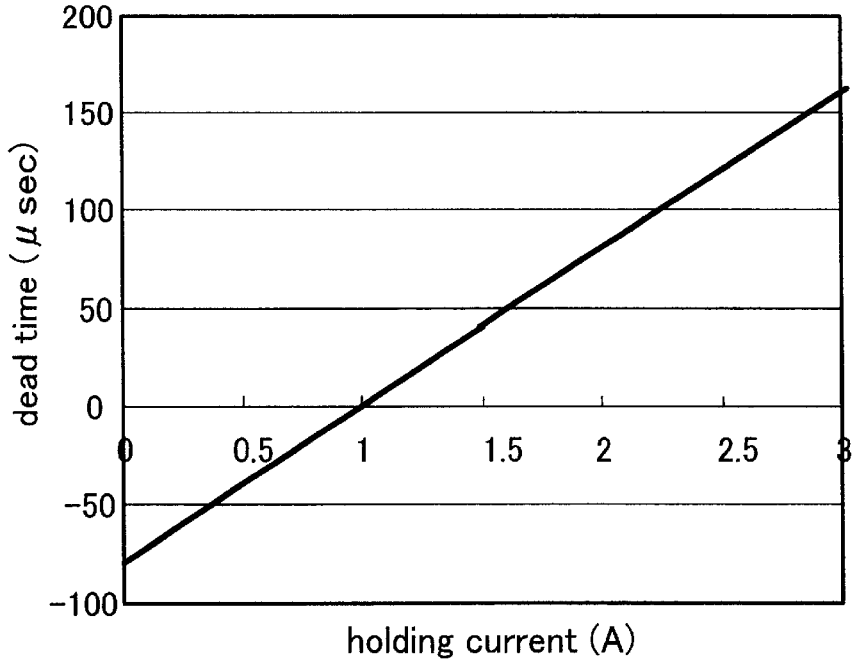
FIG. 8 is a graph showing the relationship between holding current and dead time in accordance with one embodiment of the invention.

FIG. 8 is a graph showing a relationship between the dead time and the holding current in which the dead time corresponding to the holding current of one ampere is used as a reference value. The graph has been pre-obtained through experiments and simulations and is stored as a map in the ROM 54 of the controller 50. The feedforward control part 71 receives, from the current detector 76 (FIG. 1), a signal indicating the value of the holding current supplied to the electromagnet. The feedforward control part 71 determines a fourth dead time Tinvi from the map shown in FIG. 8 based on the received current value.

The feedforward control part 71 calculates the sum of the first, second, third and fourth dead times to determine the estimated dead time Tinvm as follows:

$$Tinvm=Tinvb+Tinvv+Tangle+Tinvi \quad (4)$$

Thus, the estimated dead time Tinvm is determined based on the known parameters.

Figure 9:
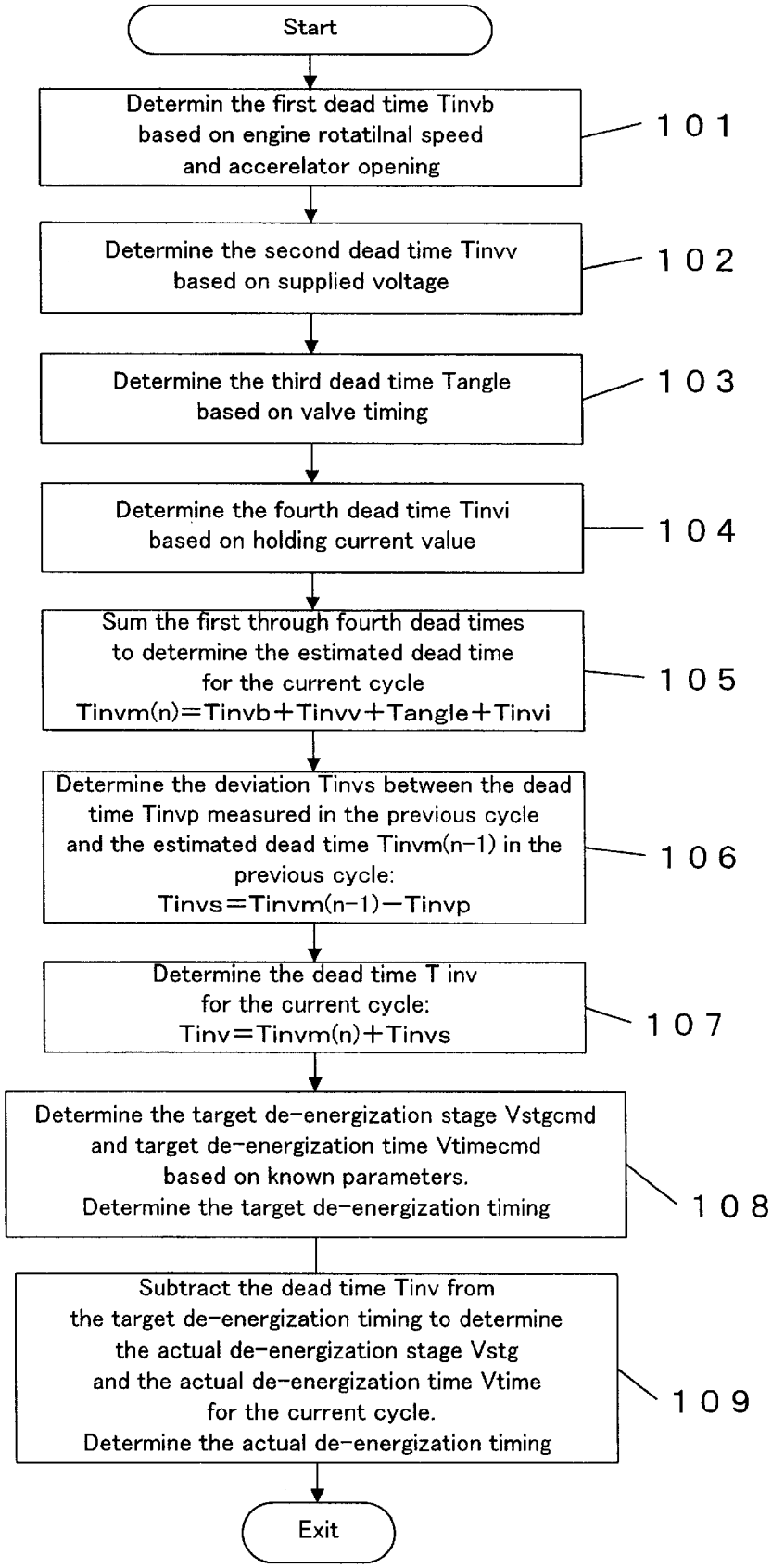
FIG. 9 is a flow chart showing the process for determining an actual de-energization timing in accordance with one embodiment of the invention.

FIG. 9 is a flow chart showing a process for determining the actual de-energization timing, which is performed by the de-energization control part 57. In steps 101 through 104, the first through fourth dead times are determined as mentioned above with reference to FIGS. 5 through 8. In step 105, the first through fourth dead times are summed up to determine the estimated dead time Tinvm(n) for the current cycle, as described above.

In step 106, which is performed by the feedback control part 72, the deviation Tinvs between the actual dead time Tinvp measured in the previous cycle and the estimated dead time Tinvm(n−1) determined in the previous cycle is determined. In step 107, the deviation Tinvs is added to the current estimated dead time Tinvm(n) to determine the dead time Tinv for the current cycle.

Steps 101 through 104 may be performed concurrently each other. Step 106 may be performed concurrently with steps 101 through 105.

In step 108, the target de-energization determination part 70 determines a target de-energization stage and a target de-energization time based on known parameters. In one embodiment, a map in which the target de-energization stage is given as a function of the valve timing (θvt) and the engine rotational speed (Ne) may be pre-stored in the ROM 54 of the controller 50. Moreover, a map in which the target de-energization time is given as a function of the accelerator opening (ACC) and the engine rotational speed (Ne) may be pre-stored in the ROM 54. In step 108, the target de-energization determination part 70 determines the target de-energization stage and the target de-energization time by referring to the maps.

The target de-energization stage indicates which cycle of the crank pulse signal the valve timing command is to be executed in. The crank pulse signal is output from a crank angle sensor in accordance with the rotation of the crankshaft. The target de-energization time indicates a time period from the starting time of the cycle corresponding to the target de-energization stage until the time when the valve timing command is executed. The time point when the target de-energization time has elapsed is identified as the target de-energization timing.

In step 109, the dead time Tinv is subtracted from the target de-energization timing to determine the actual de-energization timing for the current cycle. The actual de-energization timing is represented by an actual de-energization stage Vstg and an actual de-energization time Vtime. The actual de-energization stage Vstg indicates which cycle of the crank pulse signal the actual de-energization timing is included in. The actual de-energization time Vtime indicates a time period from the starting time of the cycle corresponding to the actual de-energization stage Vstg until the actual de-energization timing. The electromagnet is de-energized in accordance with the actual de-energization timing.

Figure 10:
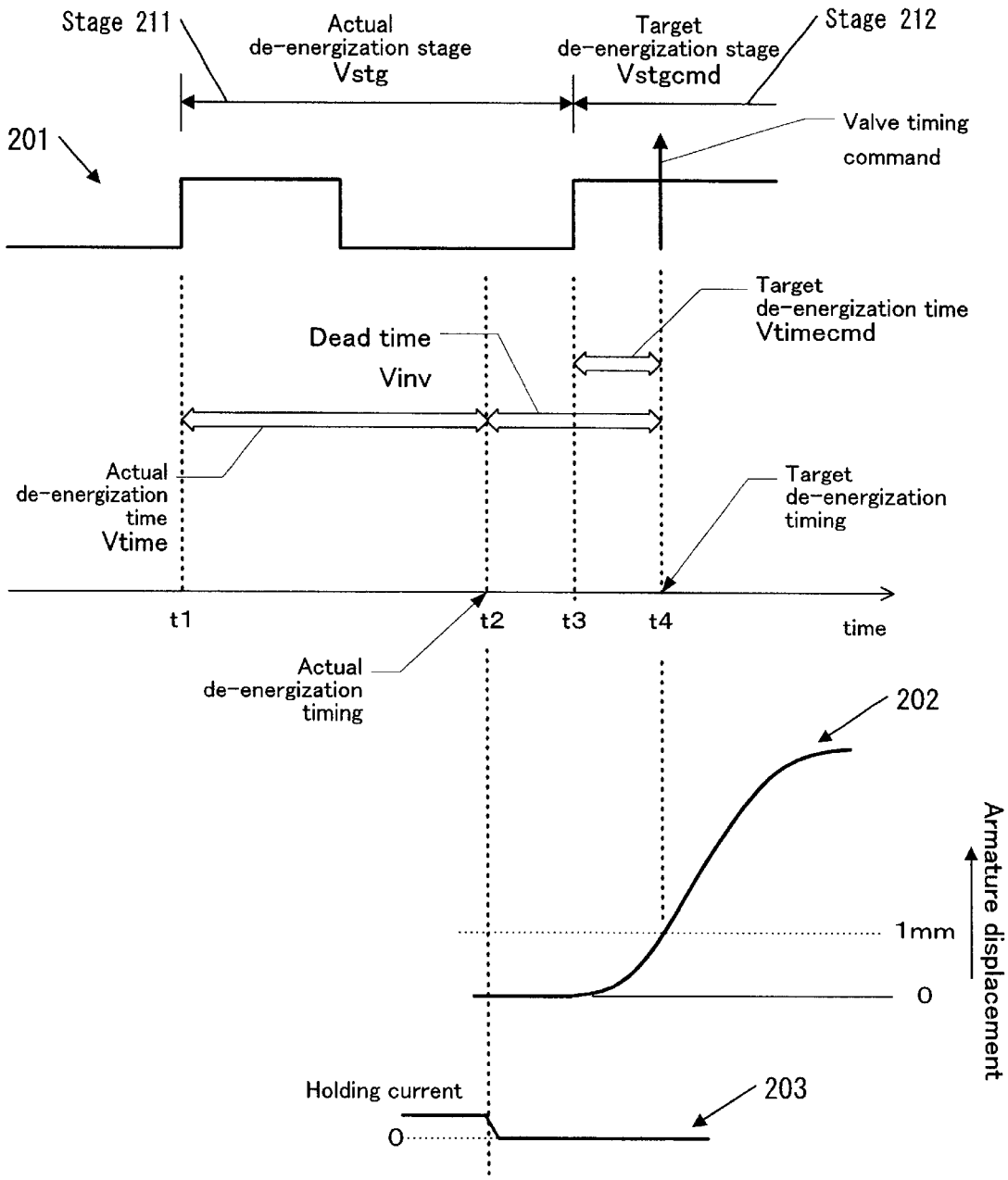
FIG. 10 is a schematic chart showing how an actual de-energization timing is determined in accordance with one embodiment of the invention.

Referring to FIG. 10, a method for determining the actual de-energization timing will be described more specifically. Reference number 201 indicates a crank pulse signal. Stage 211 indicates the current cycle beginning at time t1 while stage 212 indicates the next cycle beginning at time t3.

The de-energization control part 57 determines the target de-energization stage Vstgcmd and target de-energization time Vtimecmd based on the known parameters, as described above. In the example shown in FIG. 10, it is determined that the target de-energization stage Vstgcmd is stage 212 and the target de-energization time Vtimecmd is t3–to–t4 period. It should be noted that stage Vstgcmd is actually represented by a counter value from a cylinder-distinguishing signal. Thus, the target de-energization timing t4 is identified on the crank pulse signal. The valve timing command is executed at time t4.

Then, the de-energization control part 57 subtracts the dead time Tinv from the target de-energization timing t4 to determine that the actual de-energization timing is t2.

The actual de-energization timing is represented in terms of stage and elapsed time from the start of the stage, as described above. In this example, because the dead time Vinv is longer than the target de-energization time Vtimecmd, the dead time Vinv is extending from the stage 212 over the previous stage 211. Therefore, it is determined that the actual de-energization stage Vstg is stage 211. It is determined that the time period from t1, which is the starting time of Vstg, to t2 is the actual de-energization time Vtime. Thus, the actual de-energization timing t2 is identified on the crank pulse signal.

How to de-energize the electromagnet will be below described. The de-energization control part 57 begins to measure the elapsed time since the starting time t1 of stage 211. At time t2 when the actual de-energization time Vtime has elapsed, the de-energization control part 57 outputs a de-energization signal. In response to the de-energization signal, the driver 77 (FIG. 1) de-energizes the electromagnet, as shown by reference number 203 of FIG. 10. When the electromagnet is de-energized, the armature begins to move, as shown by reference number 202. In this example, it is assumed that the armature moves downward. At time t4 when the dead time Vinv has elapsed since the time when the de-energization was carried out, the valve timing command is issued. In response to the valve timing command, the driver 77 begins to energize the valve-opening electromagnet for activating the valve opening operation.

As seen in FIG. 10, the displacement of the armature reaches one millimeter when the valve timing command is executed. The valve opening/closing operation is activated immediately in response to the execution of the valve timing command. As a result, the accuracy of the valve timing is maintained.

Figure 11A:
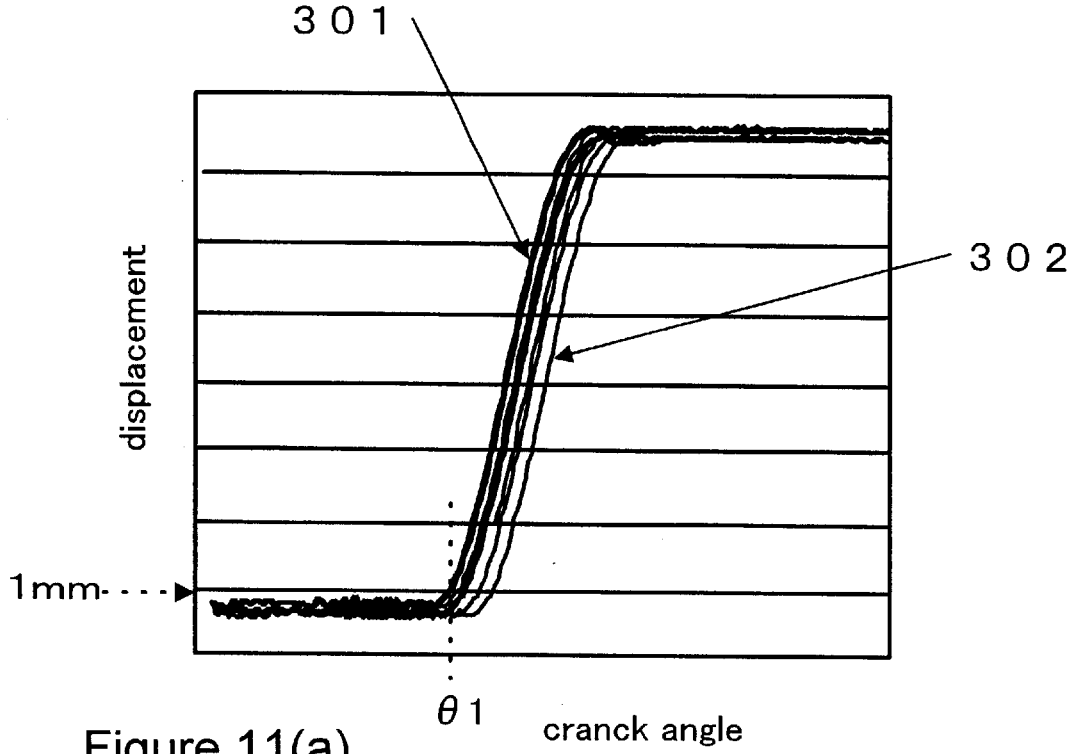
FIG. 11(*a*) is a graph showing the response of valve operation to a valve timing command when an accelerator opening is abruptly changed in accordance with a conventional method.
Figure 11B:
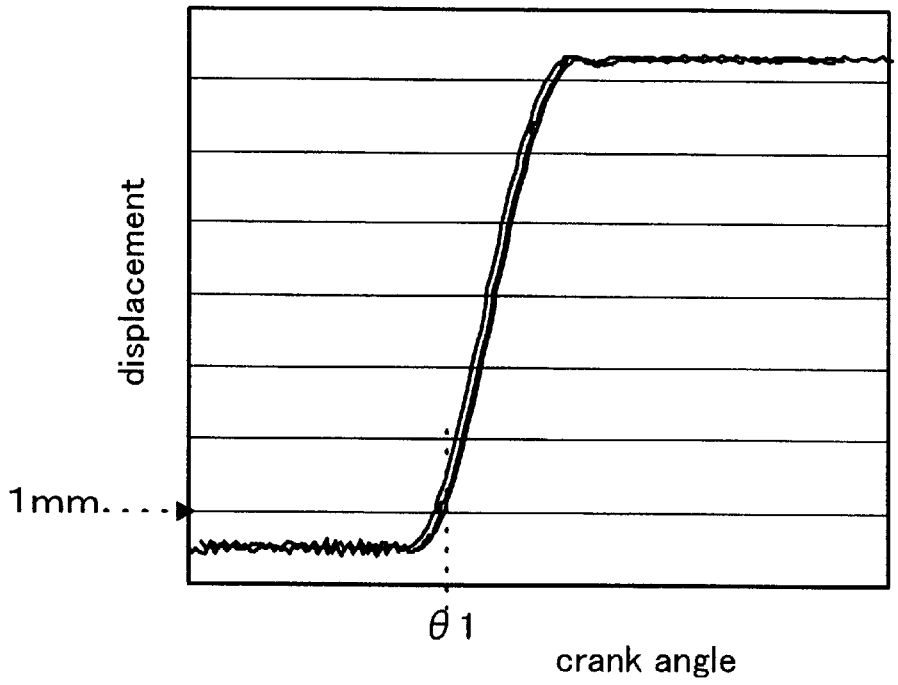

FIGS. 11(*a*) and 11(*b*) are graphs showing the armature displacement relative to the crank angle when the accelerator opening abruptly changes from 0% to 100%. It is assumed that the valve timing command is constant. FIG. 11(*a*) shows results measured in accordance with a conventional method for determining the dead time for the current cycle based on only the dead time for the previous cycle. FIG. 11(*b*) shows results measured in accordance with one embodiment of the invention.

Referring to FIG. 11(*a*), the appearance of several lines from the rightmost line 302 to the leftmost line 301 indicates that the displacements of the armature when the valve timing command is executed varies for respective cycles. For example, it is assumed that the valve timing command has been executed at the crank angle of θ1. The displacement shown by the leftmost line 301 reaches one millimeter whereas the displacement shown by the rightmost line 302 does not reach one millimeter.

According to the conventional method, the dead time for the first cycle after the accelerator opening changes from 0% to 100% may be set to be shorter than an appropriate dead time. Therefore, the armature displacement for the first cycle does not reach one millimeter yet at the time when the valve timing command is executed. This means that starting the valve opening/closing operation in response to the valve timing command may delay. The displacement of the armature reaches one millimeter after several cycles, as shown in the leftmost line 301. Thus, it may take several cycles to converge the response to the valve timing command.

Referring to FIG. 11(*b*), it is seen that the displacement of the armature reaches one millimeter when the valve timing command is executed at the crank angle of θ1. This is because the dead time for the current cycle has been determined considering the accelerator opening. Thus, in accordance with the invention, the appropriate dead time is determined even in the case of the abrupt change in the parameters. The valve opening/closing operation can be carried out quickly in response to the valve timing command.

What is claimed is:

1. A controller for controlling an electromagnetic valve; the controller being configured to:

determine an estimated dead time during opening and closing operation of the electromagnetic valve based on predetermined parameters;

determine a dead time for a current cycle in accordance with the estimated dead time; and determine an actual de-energization timing for de-energizing an electromagnet of the electromagnetic valve based on the dead time determined for the current cycle;

wherein the electromagnet of the electromagnetic valve is de-energized in accordance with the actual de-energization timing.

2. The controller of claim 1, wherein the dead time for the current cycle is a time period from the time when the electromagnet is de-energized to the time when the electromagnetic valve moves by a predetermined distance.

3. The controller of claim 2, wherein the predetermined distance is one millimeter.

4. The controller of claim 2, wherein a displacement detector determines displacement of an armature of the electromagnetic valve to determine when the electromagnetic valve moves past the predetermined distance.

5. The controller of claim 4, wherein the displacement detector comprises, a magnet, and a coil, wherein the magnet moves in unison with an armature associated with an electromagnetic actuator and the coil when energized outputs a voltage value proportional to a magnetic flux density generated by a permanent magnet.

6. The controller of claim 4, wherein the displacement detector further comprises a Hall element, wherein the Hall element detects a magnetic-flux density generated by the magnet.

7. The controller of claim 1, further configured to measure a dead time in a previous cycle; and wherein a deviation between the dead time measured in the previous cycle and an estimated dead time determined in the previous cycle is added to the estimated dead time determined in the current cycle to determine the dead time for the current cycle.

8. The controller of claim 1, further configured to determine a target de-energization timing based on the predetermined parameters and to subtract the dead time for the current cycle from the target de-energization timing to determine the actual de-energization timing, the target de-energization timing indicating when a valve timing command is to be executed.

9. The controller of claim of claim 8, wherein the target de-energization timing is determined based on valve timing and engine rotational speed.

10. The controller of claim 1, wherein the predetermined parameters include any of engine rotational speed, engine load, supplied voltage, valve timing, and holding current value.

11. The controller of claim 1, wherein the actual de-energization timing is identified on a crank pulse signal, the crank pulse signal being output in accordance with the rotation of a crankshaft.

12. The controller of claim 1, wherein the controller generates a control signal to control energiziation of the electromagnet and a second electromagnet of the electromagnetic valve based on the predetermined parameters received by the controller.

13. The controller of claim 1, wherein the controller further comprises a de-energization control module adapted to generate a timing signal when an armature of an electromagnetic actuator corresponding to the electromagnetic valve reaches a predetermined position.

14. A method for controlling an electromagnetic valve, comprising:

determining an estimated dead time during opening and closing operation of the electromagnetic valve based on predetermined parameters;

determining a dead time for a current cycle in accordance with the estimated dead time; and determining an actual de-energization timing for de-energizing an electromagnet of the electromagnetic valve based on the dead time determined for the current cycle;

wherein the electromagnet of the electromagnetic valve is de-energized in accordance with the actual de-energization timing.

15. The method of claim 14, wherein the dead time for the current cycle is a time period from the time when the electromagnet is de-energized to the time when the electromagnetic valve moves by a predetermined distance.

16. The method of claim 15, wherein the predetermined distance is one millimeter.

17. The method of claim 14, further comprising:

measuring a dead time in a previous cycle;

determining a deviation between the dead time measured in the previous cycle and an estimated dead time determined in the previous cycle; and adding the deviation to the estimated dead time determined in the current cycle to determine the dead time for the current cycle.

18. The method of claim 14, further comprising:

determining a target de-energization timing based on the predetermined parameters; and subtracting the dead time for the current cycle from the target de-energization timing to determine the actual de-energization timing;

wherein the target de-energization timing indicates when a valve timing command is to be executed.

19. The method of claim of claim 18, wherein the target de-energization timing is determined based on valve timing and engine rotational speed.

20. The method of claim 14, wherein the predetermined parameters include any of engine rotational speed, engine load, supplied voltage, valve timing, and holding current value.

21. The method of claim 14, wherein the actual de-energization timing is identified on a crank pulse signal, the crank pulse signal being output in accordance with the rotation of a crankshaft.

22. A controller for controlling an electromagnetic valve, the controller comprising means for determining an estimated dead time in opening and closing operation of the electromagnetic valve based on predetermined parameters;

means for determining a dead time for the current cycle in accordance with the estimated dead time; and means for determining an actual de-energization timing for de-energizing an electromagnetic of the electromagnetic valve based on the dead time determined for the current cycle;

wherein the electromagnet of the electromagnetic valve is de-energized in accordance with the actual de-energization timing.

* * * * *